US009422873B2

(12) United States Patent
Leone et al.

(10) Patent No.: US 9,422,873 B2
(45) Date of Patent: Aug. 23, 2016

(54) METHODS AND SYSTEMS FOR OPERATING AN ENGINE

(71) Applicant: Ford Global Technologies, LLC, Dearborn, MI (US)

(72) Inventors: Thomas G. Leone, Ypsilanti, MI (US); Jeffrey Allen Doering, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 327 days.

(21) Appl. No.: 14/105,029

(22) Filed: Dec. 12, 2013

(65) Prior Publication Data

US 2015/0167564 A1 Jun. 18, 2015

(51) Int. Cl.
*F02D 17/02* (2006.01)

(52) U.S. Cl.
CPC ..... *F02D 17/02* (2013.01)

(58) Field of Classification Search
CPC ... F02D 17/02; F02D 41/0087; F02D 41/123; F02D 2009/0245; F02D 15/00; F02D 15/02; F02D 15/04
USPC ..... 123/198 F, 198 DB, 325, 332, 481
See application file for complete search history.

(56) References Cited

U.S. PATENT DOCUMENTS 5,408,974 A * 4/1995 Lipinski ..... F02D 17/02 123/198 F
6,360,713 B1 * 3/2002 Kolmanovsky ..... F02D 17/02 123/295
6,640,543 B1 11/2003 Seal
6,662,785 B1 * 12/2003 Sloane ..... F02D 13/06 123/198 F
6,857,264 B2 2/2005 Ament
7,044,101 B1 * 5/2006 Duty ..... F02D 17/02 123/198 F
2004/0055569 A1 * 3/2004 Matthews ..... F01L 13/0005 123/399
2004/0084010 A1 * 5/2004 Kurtz ..... F02B 1/12 123/295
2007/0193557 A1 * 8/2007 Brevick ..... F02D 17/02 123/295
2011/0120421 A1 5/2011 Engineer
2012/0204832 A1 * 8/2012 Baur ..... F02D 13/0219 123/406.19
2013/0276747 A1 * 10/2013 Springer ..... F02D 17/02 123/319
2013/0276749 A1 * 10/2013 Springer ..... F02D 17/02 123/349
2013/0276755 A1 * 10/2013 Springer ..... F02D 17/02 123/435
2013/0276759 A1 * 10/2013 Springer ..... F02B 75/04 123/48 R

FOREIGN PATENT DOCUMENTS

WO 2011067865 A1 6/2011

* cited by examiner

*Primary Examiner* — Hung Q Nguyen
*Assistant Examiner* — Xiao Mo
(74) *Attorney, Agent, or Firm* — Julia Voutyras; Alleman Hall McCoy Russell & Tuttle LLP

(57) ABSTRACT

Systems and methods for improving operation of an engine are presented. In one example, a threshold torque at which deactivated engine cylinders are reactivated is adjusted in response to a varying engine compression ratio. In other examples, the torque threshold is adjusted in response to a rate of change in engine torque and engine compression ratio.

18 Claims, 7 Drawing Sheets

METHODS AND SYSTEMS FOR OPERATING AN ENGINE

FIELD

The present description relates to a system and methods for improving engine efficiency and performance. The systems and methods may be particularly useful for engines that include cylinder deactivation and variable compression ratio.

BACKGROUND AND SUMMARY

An engine of a vehicle may include cylinder deactivation to improve engine efficiency. Engine cylinders may be selectively activated and deactivated to reduce engine pumping losses and adjust engine torque output. The engine cylinders may be activated and deactivated based on an engine torque threshold. For example, if the desired engine torque is greater than a threshold torque, all engine cylinders may be activated. If desired engine torque is less than the threshold torque, a fraction of engine cylinders maybe activated. Thus, the threshold engine torque is a condition for selecting between differing active cylinder displacements. However, it may not be desirable for the engine to switch between different active cylinder displacements at the same engine torque threshold at all times.

The inventors herein have recognized the above-mentioned disadvantages and have developed a method for operating an engine, comprising: varying an engine torque at which engine cylinders are activated in response to a compression ratio of the engine.

By adjusting an engine torque at which deactivated engine cylinders are reactivated in response to a compression ratio of an engine, it may be possible to provide the technical result of reducing the possibility of engine knock during cylinder reactivation. Further, it may be possible to increase engine efficiency since the method described herein provides a way to select different engine compression ratios in response to when the engine may operate more efficiently with the selected compression ratio.

In some examples, the torque threshold at which deactivated engine cylinders are reactivated may be adjusted in response to a rate of engine torque increase. For example, if engine torque is increased at a higher rate, the torque threshold at which deactivated engine cylinders are reactivated may be decreased as compared to the torque threshold at which deactivated engine cylinders are reactivated when engine torque is increased at a lesser rate. Further, adjustment of a compression ratio of the engine may be delayed until deactivated cylinders are reactivated when the rate of change in engine torque is greater than a threshold rate of change in engine torque.

The present description may provide several advantages. Specifically, the approach may reduce engine knock. Additionally, the approach may improve engine efficiency. Further, the approach may improve vehicle drivability by reducing the possibility of adjusting engine compression ratio at the same time cylinders are being activated or deactivated.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
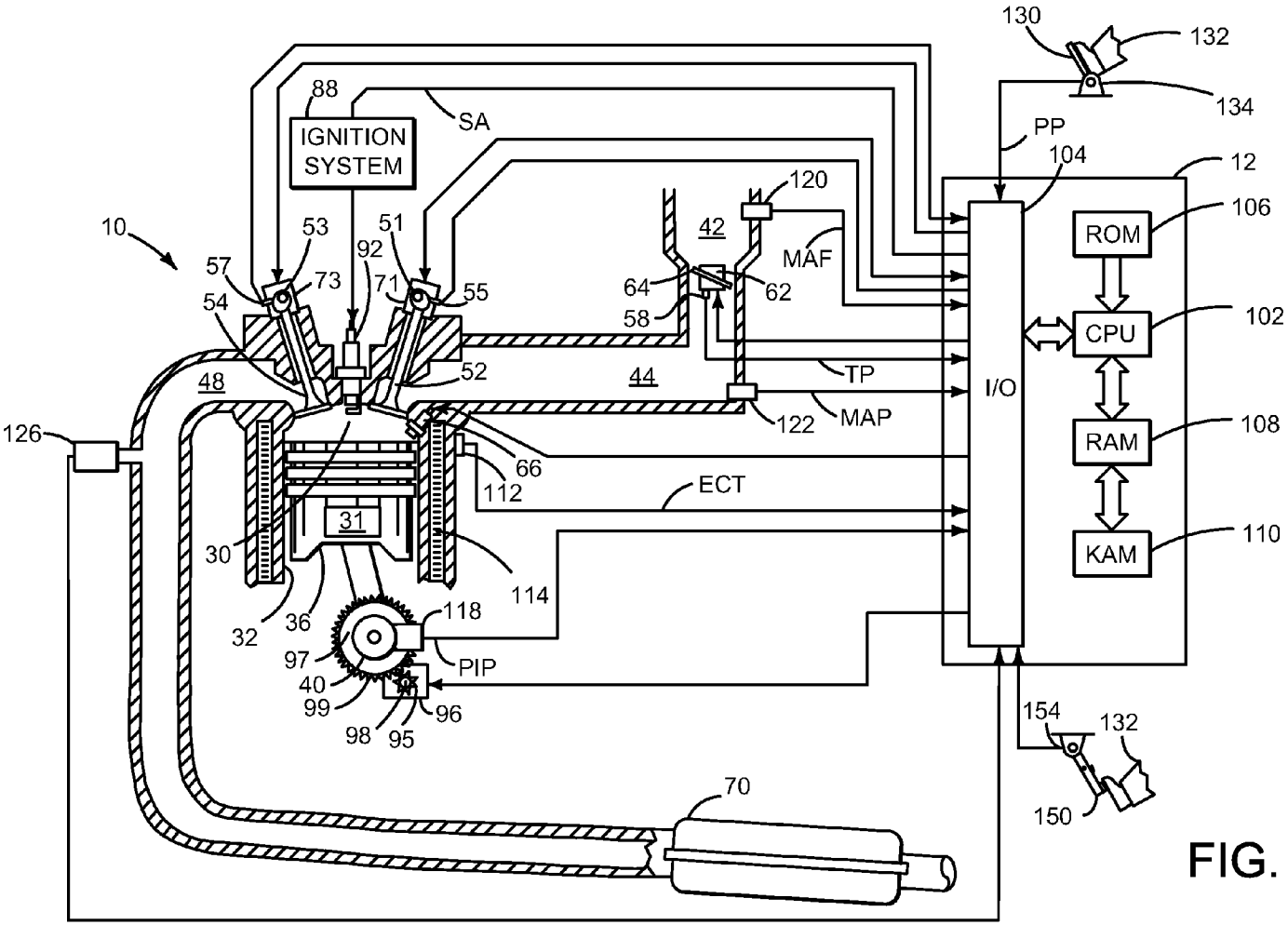
FIG. 1 is a schematic diagram of an engine.
Figure 2:
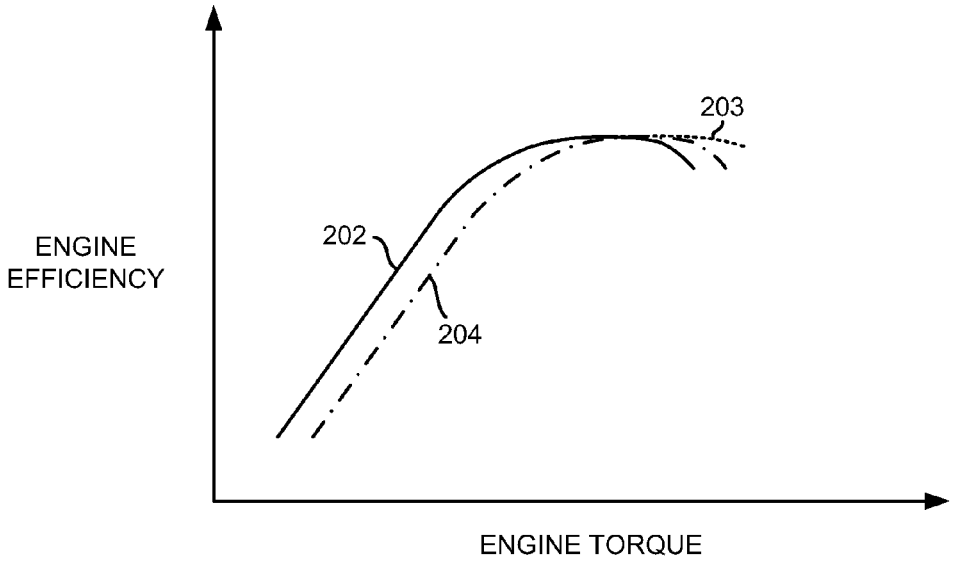
FIGS. 2 and 3 show example simulated plots of engine efficiency versus engine torque.
Figure 3:
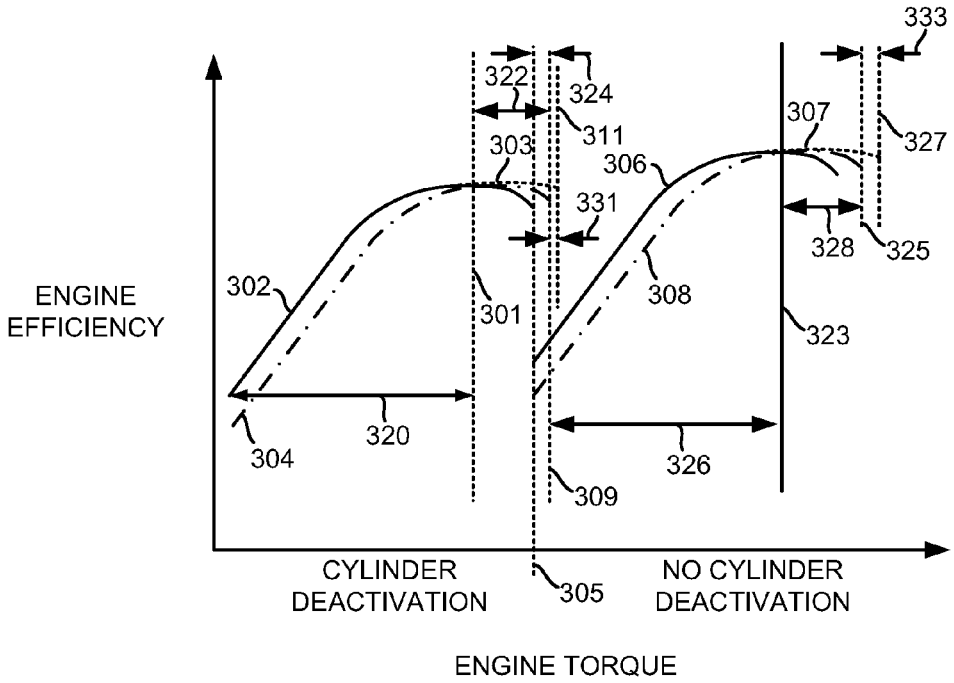

The present description is related to controlling operation of an engine that may selectively activate and deactivate cylinders to vary active cylinder displacement. The engine may also include capabilities for variable compression rates. FIG. 1 shows an example engine system that includes mechanisms for varying both active cylinder displacement and compression ratio. The engine may operate as indicated in the engine efficiency versus engine torque plots as shown in FIGS. 2 and 3. The engine may also operate as shown in the sequence shown in FIG. 4. FIGS. 5-8 are a flowchart of a method for operating an engine. The engine of FIG. 1 may be operated according to the method of FIGS. 5-8 to provide the sequence shown in FIG. 4.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Variable compression adjusting device 31 may increase or decrease compression in cylinders by increasing or decreasing piston height. Alternatively, variable compression adjusting device 31 may adjust the effective connecting rod length, cranktrain geometry, crankshaft position, cylinder head position, or clearance volume to adjust the engine compression ratio. In still other examples, the effective engine compression ratio may be adjusted via advancing or retarding timing of intake valve 52 via valve adjusting mechanism 71.

Flywheel 97 and ring gear 99 are coupled to crankshaft 40. Starter 96 includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply torque to crankshaft 40 via a belt or chain. In one example, starter 96 is in a base state when not engaged to the engine crankshaft. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57. Intake cam 51 and exhaust cam 53 may be moved relative to crankshaft 40 via valve adjusting mechanisms 71 and 73. Valve adjusting mechanisms 71 and 73 may also deactivate intake and/or exhaust valves in closed positions so that intake valve 52 and exhaust valve 54 remain closed during a cylinder cycle.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal from controller 12. Fuel is delivered to fuel injector 66 by a fuel system (not shown) including a fuel tank, fuel pump, and fuel rail (not shown). In one example, a high pressure, dual stage, fuel system may be used to generate higher fuel pressures. In addition, intake manifold 44 is shown communicating with optional electronic throttle 62 which adjusts a position of throttle plate 64 to control air flow from air intake 42 to intake manifold 44. In some examples, throttle 62 and throttle plate 64 may be positioned between intake valve 52 and intake manifold 44 such that throttle 62 is a port throttle.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by driver 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; brake pedal position from brake pedal position sensor 154 when driver 132 applies brake pedal 150; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. Further, in some examples, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Referring now to FIG. 2, a plot of engine torque versus engine efficiency for an engine not having selective cylinder deactivation and activation is shown. The Y axis represents engine efficiency and engine efficiency increases in the direction of the Y axis arrow. The X axis represents engine torque and engine torque increases in the direction of the X axis arrow.

Solid line 202 represents engine efficiency versus engine torque for a knock limited engine operating with a higher compression ratio (e.g., 11:1). Dash dot line 204 represents engine efficiency versus engine torque for the same engine operating with a lower compression ratio (e.g., 9:1). Dotted line 203 represents engine efficiency for the same engine when the engine is not knock limited while operating with a higher compression ratio. Dotted line 203 is not visible where solid line 202 overlaps dotted line 203.

Thus, it may be observed that the engine operates more efficiently at lower to middle torque levels when the engine is operated with a higher compression ratio. However, at higher engine torques, when the engine is knock limited with the higher compression ratio, engine efficiency and torque are reduced at higher engine torques (e.g., due to spark retard) as compared to when the same engine is operated with a lower compression ratio or when the engine is not knock limited. Additionally, when the engine is operated with a higher compression ratio and is not knock limited, engine efficiency and torque are improved as compared to when the same engine is operated with a lower compression ratio.

Referring now to FIG. 3, a plot of an engine operating with knock limited higher compression ratio, lower compression ratio, not knock limited higher compression ratio, cylinder deactivation, and all cylinders active is shown. The Y axis represents engine efficiency and engine efficiency increases in the direction of the Y axis arrow. The X axis represents engine torque and engine torque increases in the direction of the X axis arrow.

Vertical line 301 represents a first engine torque threshold for adjusting engine compression ratio. Vertical line 305 represents a second engine torque threshold for activating deactivated cylinders when the engine is operating with a higher compression ratio and is knock limited. Vertical line 309 represents a third engine torque threshold for activating deactivated cylinders when the engine is operating with a lower compression ratio. Vertical line 311 represents a fourth engine torque threshold for activating deactivated cylinders when the engine is operating with a higher compression ratio and is not knock limited. Vertical line 323 represent a fifth engine torque threshold for adjusting engine compression ratio. Vertical line 325 represents a maximum engine torque when the engine is operating with all cylinders active at a lower compression ratio. Vertical line 327 represents a maximum engine torque when the engine is operating with all cylinders active at a higher compression ratio and is not knock limited.

Solid lines 302 and 306 represent engine efficiency versus engine torque for a knock limited engine operating with a higher compression ratio (e.g., 11:1). Dash dot lines 304 and 308 represent engine efficiency versus engine torque for the same engine operating with a lower compression ratio (e.g., 9:1). Dotted lines 303 and 307 represent engine efficiency for the same engine when the engine is not knock limited while operating with a higher compression ratio. Dotted lines 303 and 307 are not visible where solid lines 302 and 306 overlap dotted lines 303 and 307. Lines 302, 304, and 303 represent engine efficiency versus engine torque when a fraction of engine cylinders are deactivated (e.g., no spark or fuel while intake and exhaust valves are closed during a cylinder cycle). Lines 306, 308, and 307 represent engine efficiency versus engine torque when all engine cylinders are operating.

A first engine torque region A is indicated by arrow 320. Region A begins at a low engine torque and it ends at an intersection of lines 302 and 304. The intersection represents an engine operating condition where engine efficiency versus engine torque is equivalent when the engine is operating with higher or lower compression. It may be observed that it may be more desirable to operate the engine with a higher compression ratio in region A since engine efficiency is improved by the higher compression ratio.

A second engine torque region B is the amount of engine torque between vertical line 301 and vertical line 305. Region B ends at the maximum engine torque for operating the engine in a knock limited higher compression mode when a fraction of engine cylinders are deactivated.

A third engine torque region C is the amount of engine torque between vertical line 301 and vertical line 309, which is indicated by arrow 322. Region C ends at the maximum engine torque for operating the engine in a lower compression mode when a fraction of engine cylinders are deactivated. The engine operates with higher efficiency in region C as compared to when the engine is operated in region B. The increase of engine torque between operating the engine in region B and C is indicated by arrow 324. Thus, it may be more desirable to operate the engine with a lower compression ratio in region C since engine efficiency is improved with a lower engine compression ratio.

A fourth engine torque region D is the amount of engine torque between vertical line 301 and vertical line 311. Region D ends at the maximum engine torque for operating the engine in a higher compression mode where the engine is not knock limited. The engine may not be knock limited during selected conditions such as when the engine is not warm and when ambient temperature is less than a threshold value, or when high octane fuel is used. The engine operates with higher efficiency and torque in region D as compared to when the engine is operated in regions B and C. The increase of engine torque between operating the engine in region C and D is indicated by arrow 331.

A fifth engine torque region E is the amount of engine torque between vertical line 309 and line 323. However, in some examples region E may be expressed as the amount of engine torque between line 305 and line 323, or between line 311 and line 323. Line 323 is the amount of torque at the intersection of lines 306 and 308. It may be observed that it may be more desirable to operate the engine with a higher compression ratio in region E since engine efficiency is improved by the higher compression ratio.

A sixth engine torque region F is the amount of engine torque between vertical line 323 and line 325, which is indicated by arrow 328. Region F may be extended from line 323 to line 327, thereby increasing engine torque by an amount indicated by arrow 333 if the engine may be operated with a higher compression ratio without being knock limited.

The inventors herein have recognized that the engine may be operated most efficiently when the engine is knock limited by following line 302 to vertical line 301, following line 304 from vertical line 301 to vertical line 309, following line 306 from vertical line 309 to vertical line 323, and following line 308 to higher engine torques. Thus, if the engine transitions from a lower torque to a higher torque, the engine may start with a group of cylinders deactivated while active cylinders operate at a higher compression ratio, the engine switches to a lower compression as engine torque increases while selected cylinders remain deactivated, engine cylinders are reactivated and compression ratio in all cylinders is increased to a higher compression ratio as engine torque increases further, and the engine switches to lower compression with all cylinders active at even higher engine torques. In this way, engine efficiency may be maintained at a higher level while engine torque transitions from a lower torque to a higher torque.

On the other hand, if engine torque is changing by more than a threshold rate of engine torque increase or decrease, it may be desirable to maintain the engine at a higher compression ratio before and after reactivating cylinders so that the engine may produce as much torque as possible in a short amount of time. Further, by maintaining the engine compression ratio during cylinder reactivation, it may be possible to provide a smoother torque transition between deactivating and reactivating cylinders. Thus, changes in engine compression ratio may be inhibited or stopped when the rate of engine torque change is greater than a threshold amount.

FIG. 3 illustrates an engine which can only deactivate a constant fraction of the cylinders, for example a 6-cylinder engine which can deactivate 3 cylinders. It is well known that other arrangements are possible, for example a 6-cylinder engine which can deactivate either 2 or 3 cylinders at various times. Such engines would have multiple torque regions with various combinations of compression ratio and number of deactivated cylinders, but the logic would be similar to FIG. 3.

Figure 4:
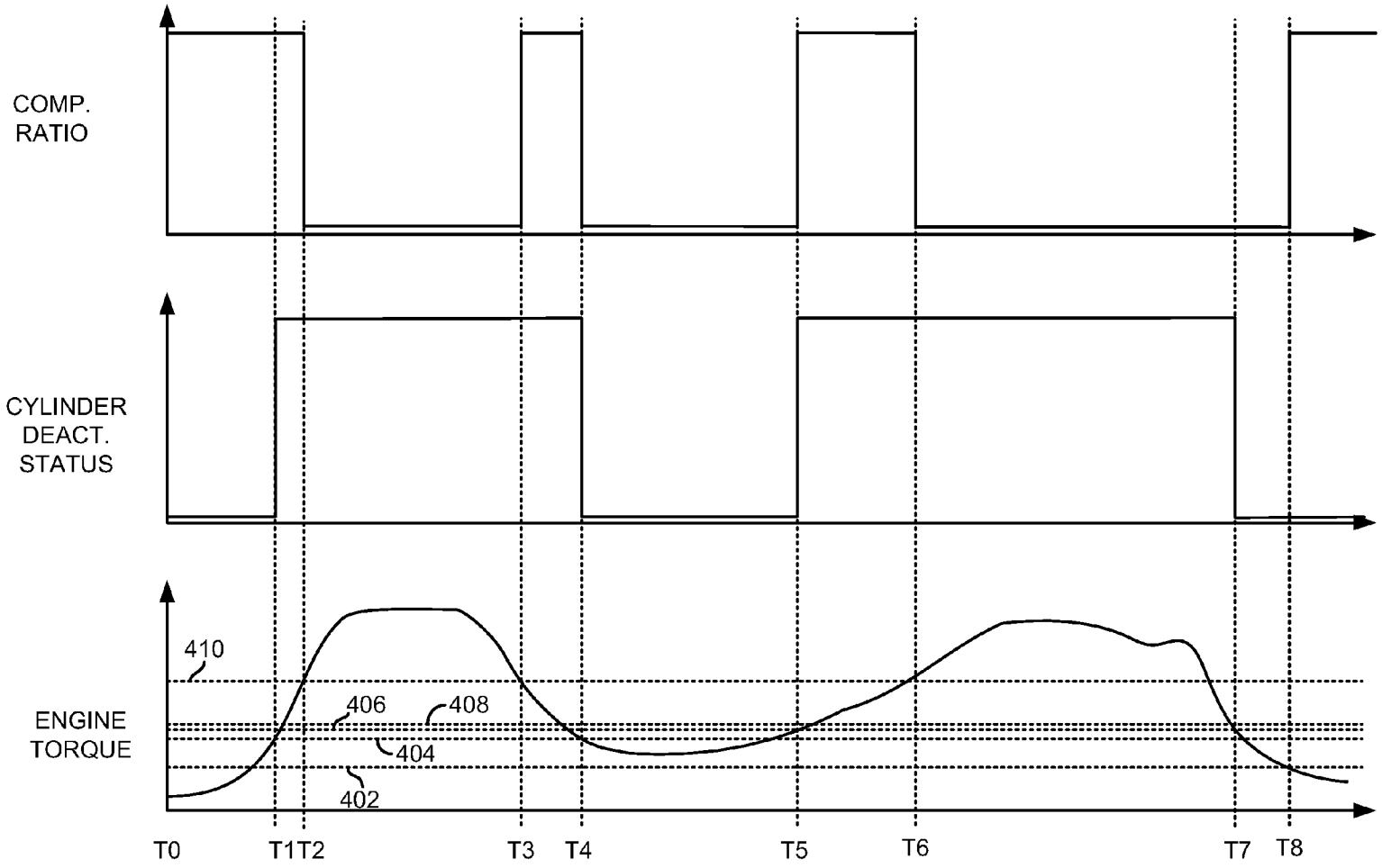
FIG. 4 shows an example simulated engine operating sequence.
Figure 5:
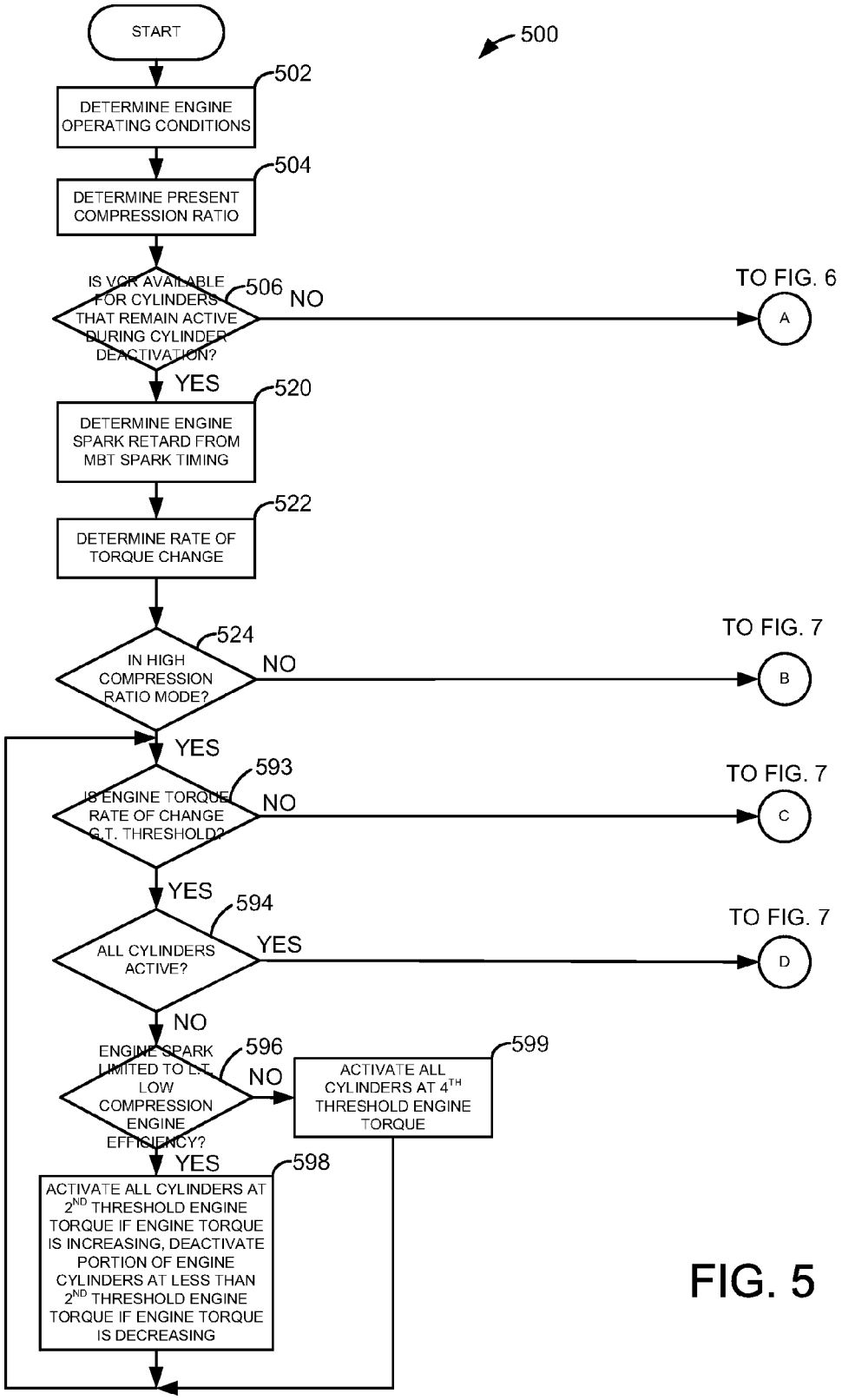
FIGS. 5-8 show an example method for operating an engine.
Figure 6:
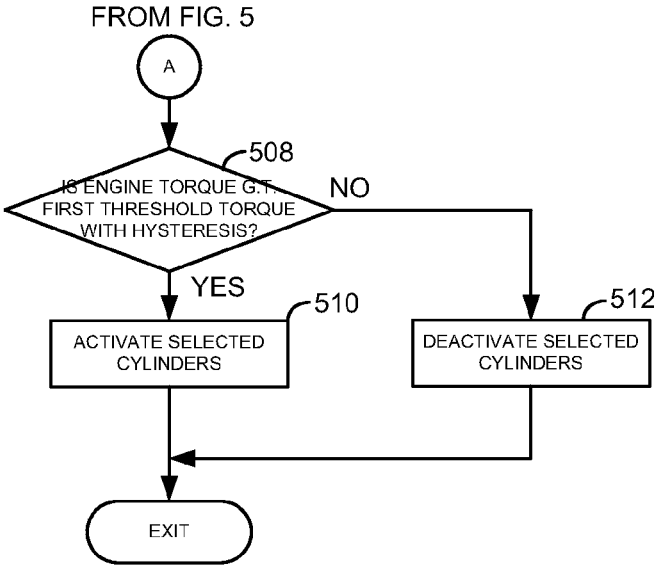
Figure 7:
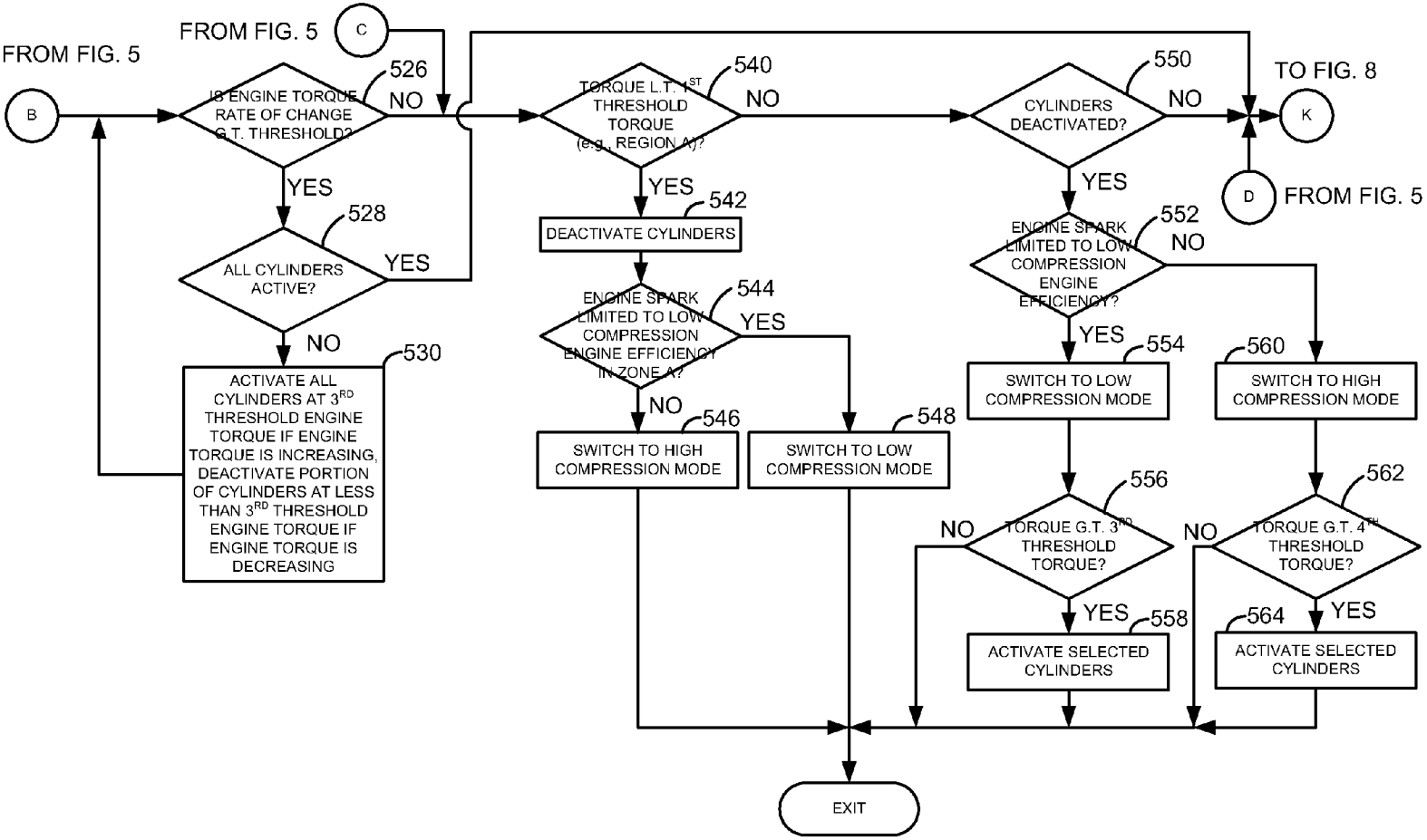
Figure 8:
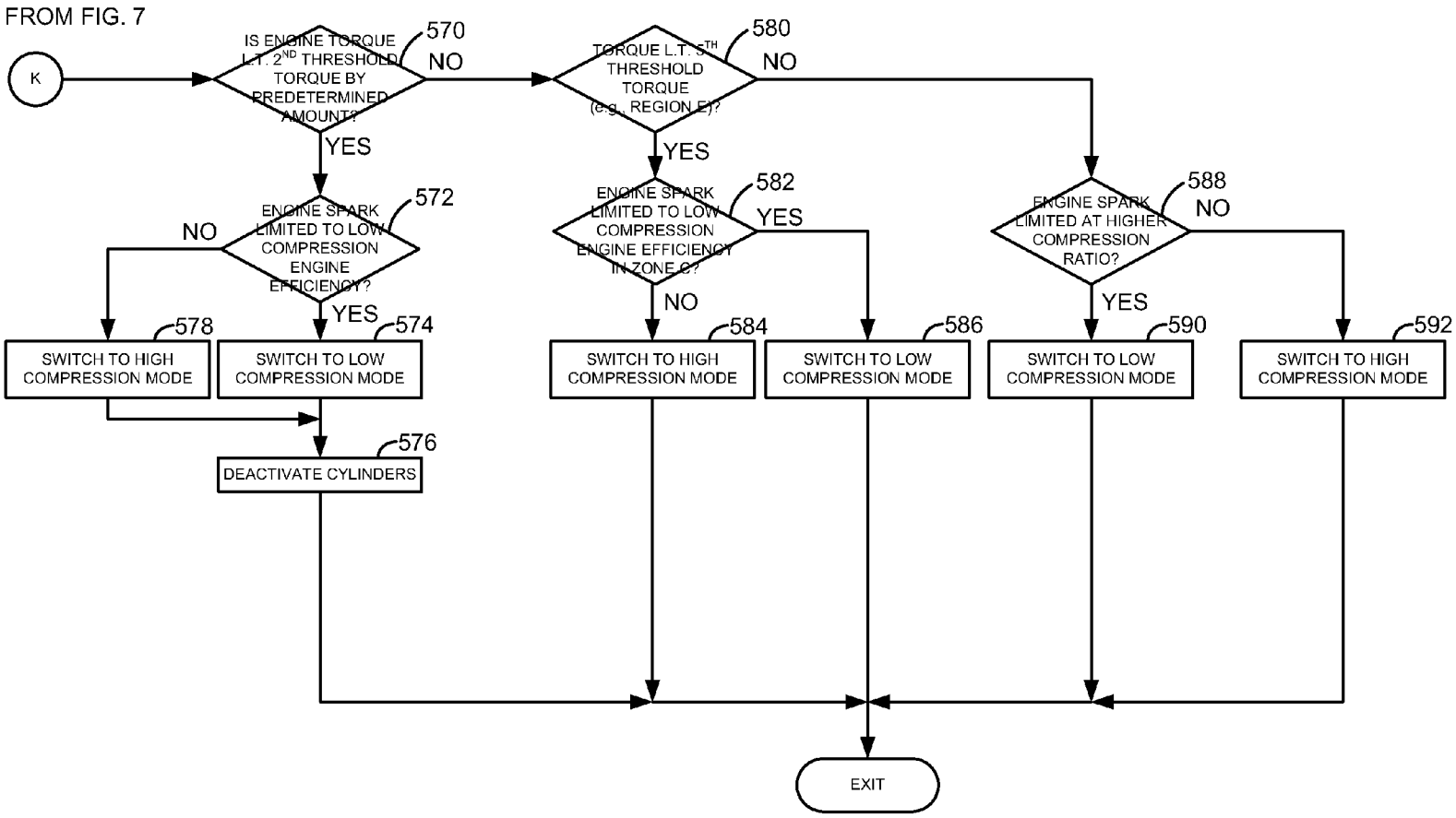

Referring now to FIG. 4, an example engine operating sequence is shown. The operating sequence of FIG. 4 may be provided by the engine system of FIG. 1 executing the method of FIGS. 5-8. Times of interest in the sequence are indicated by vertical time markers T0-T8.

The first plot from the top of FIG. 4 is a plot of engine compression ratio versus time. The Y axis represents compression ratio. A lower compression ratio is indicated when the compression ratio trace is closer to the X axis. A higher compression ratio is indicated when the compression ratio trace is closer to the Y axis arrow. The X axis represents time and time increases in the direction of the X axis arrow.

The second plot from the top of FIG. 4 is a plot of engine cylinder deactivation status versus time. The Y axis represents cylinder deactivation status. Deactivated cylinders are indicated when the cylinder deactivation trace is closer to the X axis. All cylinders active is indicated when the engine cylinder deactivation trace is closer to the Y axis arrow. The X axis represents time and time increases in the direction of the X axis arrow.

The third plot from the top of FIG. 4 is a plot of engine torque versus time. The Y axis represents engine torque, or alternatively desired engine torque, and engine torque increases in the direction of the Y axis arrow. The X axis represents time and time increases in the direction of the X axis arrow. Horizontal line 402 represents a first engine torque amount where an engine may be switched from a higher compression ratio to a lower compression ratio (e.g., torque at line 301 of FIG. 3). Horizontal line 404 represents a second engine torque amount where an engine may be switched from operating with deactivated cylinders to being operated with all active cylinders when the engine is knock limited and operated at a higher compression ratio (e.g., torque at line 305 of FIG. 3). Horizontal line 406 represents a third engine torque amount where an engine may be switched from operating with deactivated cylinders to being operated with all active cylinders when the engine is operated at a lower compression ratio (e.g., torque at line 309 of FIG. 3). Horizontal line 408 represents a fourth engine torque amount where an engine may be switched from operating with deactivated cylinders to being operated with all active cylinders when the engine is not knock limited and is operated at a higher compression ratio (e.g., torque at line 311 of FIG. 3). Horizontal line 410 represents a fifth engine torque amount where the engine may be switched from operating with a higher compression ratio to operating with a lower compression ratio (e.g., torque at line 323 of FIG. 3).

At time T0, the engine compression ratio is at a higher level, cylinders are deactivated, and the engine torque amount is low. Such conditions may be representative of when a vehicle in which the engine operates is at very low vehicle speed.

Between time T0 and time T1, the engine torque increases at a rate greater than a threshold rate of torque increase. The compression ratio is maintained at a higher level and the cylinders remain deactivated.

At time T1, cylinders are reactivated without the engine compression ratio having changed from a higher level to a lower level. The engine cylinders are reactivated at an engine torque level indicated by line 404 and in response to the rate of engine torque increasing by more than a threshold amount.

At time T2, the engine torque has continued to increase to a level indicated by line 410. The engine compression ratio is reduced from a higher level to a lower level to improve engine efficiency and increase the amount of available engine torque since the engine is knock limited at higher engine torque in this example. In this way, a transition from operating the engine at a higher compression ratio to lower compression ratio may be avoided during engine torque changes that are greater than a threshold rate of torque change. However, in some examples, it may be desirable to switch engine compression ratio and activate cylinders at the same engine torque. Additionally, if the engine had been operating at a lower compression ratio before the engine cylinders were reactivated, the engine would have continued to operate in the lower compression mode until after all cylinders were reactivated.

Between time T2 and time T3, the engine torque increases and then begins to decrease. The engine compression ratio and number of active cylinders remains constant during this time.

At time T3, the engine torque is below a threshold and the rate of engine torque change is less than a threshold amount. Therefore, the engine compression ratio is increased from a lower compression ratio to a higher compression ratio to increase engine efficiency. The number of active cylinders remains the same and engine torque continues to decrease.

At time T4, the engine torque is reduced to a predetermined torque less than the engine torque level indicated by line 406. Therefore, a portion of engine cylinders are deactivated and engine compression ratio is reduced in response to the engine torque being less than the torque indicated by line 406. The engine torque levels out to a value between torques indicated by lines 402 and 406.

At time T5, the engine torque has increased to a level of torque indicated by line 406. Consequently, all engine cylinders are reactivated and the engine compression ratio is increased to a higher compression ratio to improve engine torque output and efficiency. The engine torque at and before time T5 is changing at a rate less than a threshold rate of torque change. As a result, the engine compression ratio and number of active cylinders is not changed in response to the rate of torque change, but rather in response to the engine torque amount.

At time T6, the engine torque amount has increased to a level indicated by line 410. The engine compression ratio is reduced and all cylinders remain activated in response to the engine reaching the torque level of line 410 so that engine efficiency and maximum torque may be increased. The engine torque continues to increase after time T6.

Engine torque decreases at a rate greater than a threshold amount before time T7. The engine is also operating with all cylinders active and a lower compression ratio before time T7. Engine cylinders are deactivated at time T7 in response to the engine torque being lower than the level indicated by line 406 and the rate of engine torque changing by more than a threshold rate of torque change. In this way, engine cylinders may be deactivated without the engine first having to change back and forth between lower and higher compression modes before engine cylinders are deactivated.

At time T8, the engine torque is reduced to a level indicated by line 402. The engine compression ratio is increased at time T8 in response to engine torque being less than the level indicated by line 402. The engine compression ratio is increased at time T8 to improve engine efficiency at lower engine torques.

Thus, engine compression ratio and cylinder activation/deactivation may be adjusted or varied in response to engine torque and rate of engine torque change. By changing engine compression ratio responsive to engine torque, engine efficiency may be improved. However, frequency of engine compression ratio changes may be reduced in response to a higher rate of engine torque change so that busyness of compression ratio changes may be reduced, thereby reducing the possibility of inducing torque disturbances to the vehicle driveline.

Referring now to FIGS. 5-8, a method for operating an engine is described. The method of FIGS. 5-8 may be included as executable instructions stored in non-transitory memory of a controller as shown in FIG. 1. The method of FIGS. 5-8 may provide the operating sequence shown in FIG. 4.

At 502, method 500 determines engine operating conditions, which may include engine torque, engine speed, engine temperature, ambient temperature, fuel octane, etc. In one example, engine torque may be estimated based on engine speed and an amount of air entering the engine. The engine air amount and speed are used to index a table or function that describes engine torque as a function of engine air amount and engine speed. Engine speed is determined from engine crankshaft position. Method 500 proceeds to 504 after engine operating conditions are determined.

At 504, method 500 determines a present engine compression ratio. In one example, the present engine compression ratio may be determined via a position of an engine compression ratio adjusting device. Alternatively, method 500 may determine engine compression ratio from a value of a variable stored in memory. Method 500 proceeds to 506 after the engine compression ratio is determined.

At 506, method 500 judges whether or not variable compression ratio (VCR) for engine cylinders is available. In some examples, all engine cylinders may include compression ratio adjusting devices. In other examples, only cylinders that are active at all times may include compression ratio adjusting devices. Method 500 may judge whether or not the engine is a variable compression ratio engine based on a value of a variable stored in controller memory. If method 500 judges that the engine is a variable compression ratio engine, the answer is yes and method 500 proceeds to 520. Otherwise, the answer is no and method 500 proceeds to 508.

At 508, method 500 judges whether or not engine torque is greater than (G.T.) a threshold torque where engine cylinders are to be reactivated. If method 500 judges that engine torque is greater than the threshold torque, the answer is yes and method 500 proceeds to 510. Otherwise, the answer is no and method 500 proceeds to 512.

It should be noted that hysteresis may also be included at 508 so that busyness of cylinder activation and deactivation may be reduced. For example, if engine torque is decreasing, method 500 may not move to 512 until engine torque is less than the threshold torque by a predetermined amount.

At 510, method 500 activates all or a subset of engine cylinders to increase the engine's output torque capacity. Engine cylinders may be reactivated by allowing intake and exhaust valves to open and close during a cylinder cycle. Further, spark and fuel may be supplied to engine cylinders to reactivate the cylinders. Method 500 proceeds to exit after engine cylinders are reactivated.

At 512, method 500 deactivates a portion of engine cylinders to reduce the engine torque capacity and engine pumping losses. Engine cylinders may be deactivated by closing and holding closed intake and exhaust valves during an engine cycle. Fuel and spark may also stop being provided to cylinders that are deactivated. Method 500 proceeds to exit after engine cylinders are deactivated.

At 520, method 500 determines engine spark retard from minimum spark advance for best torque (MBT spark timing). In one example, MBT spark timing for the present engine speed and torque is stored in controller memory. Spark retard from MBT spark timing is determined by subtracting the present spark timing from MBT spark timing. The present spark timing may be adjusted to a more retarded value in response to engine knock. The amount of spark retard from MBT spark timing may be a basis for switching from a higher compression ratio to a lower compression ratio. Method 500 proceeds to 522 after spark retard from MBT spark timing is determined.

At 522, method 500 determines a rate of change in engine torque. In one example, rate of engine torque change is determined by subtracting a last past value of engine torque from a present value of engine torque. The rate of change of engine torque may be positive if engine torque is increasing and negative if engine torque is decreasing. Method 500 proceeds to 524 after the rate of engine torque change is determined.

At 524, method 500 judges whether or not the engine is in a higher compression mode. Method 500 may judge whether or not the engine is in a higher compression ratio based on a position of a variable compression adjusting device or a value of a variable stored in controller memory. If method 500 judges that the engine is operating at a higher compression ratio, the answer is yes and method 500 proceeds to 593. Otherwise, the answer is no and method 500 proceeds to 528.

At 528, method 500 judges whether or not the rate of engine torque change determined at 522 is greater than a threshold rate. The threshold rate of engine torque change may vary with engine speed, engine temperature, and other operating conditions. If method 500 judges that the rate of engine torque change is greater than a threshold rate, the answer is yes and method 500 proceeds to 530. Otherwise, the answer is no and method 500 proceeds to 540.

At 528, method judges whether or not all engine cylinders are active. In one example, method 500 judges whether or not all cylinders are active based on engine valve states or a value of a variable stored in controller memory. If method 500 judges that all cylinders are active, the answer is yes and method 500 proceeds to 570. Otherwise, the answer is no and method 500 proceeds to 532.

At 530, method 500 activates all engine cylinders when engine torque is greater than a third threshold torque level (e.g., line 309 of FIG. 3), which represents engine torque for reactivating deactivated engine cylinders when the engine is operating at a lower compression ratio before cylinders are reactivated. If engine torque is less than the third threshold torque level and engine torque is increasing, engine cylinders are not reactivated. On the other hand, if engine torque is decreasing, a portion of engine cylinders are deactivated when engine torque is a predetermined amount of torque less than the third threshold engine torque. Method 500 returns to 528 after engine cylinders are conditionally reactivated.

At 540, method 500 judges whether or not engine torque is less than (L.T.) a first threshold torque (e.g., line 301 of FIG. 3). The first torque represents an engine torque for adjusting from a lower compression ratio to a higher compression ratio. The first torque is at an intersection of engine efficiency versus engine torque curves for higher and lower engine compression ratios. If method 500 judges that engine torque is less than the first torque, the answer is yes and method 500 proceeds to 542. Otherwise, the answer is no and method 500 proceeds to 550.

At 542, method 500 deactivates a portion of engine cylinders. Engine cylinders are deactivated by closing and holding closed cylinder intake and exhaust valves during a cycle of the engine. Additionally, spark and fuel flow to the cylinders is also stopped. Method 500 proceeds to 544 after a portion of engine cylinders are deactivated.

At 544, method 500 judges whether or not the engine is spark is limited to low compression efficiency for torques less than the first threshold torque (e.g., region A of FIG. 3). In one example, the engine is spark limited to lower compression ratio engine efficiency when spark retard from MBT determined at 520 is greater than a threshold amount of spark retard. Further, the spark retard from MBT spark timing for particular engine operating conditions may be stored in memory and used to adjust a curve (e.g., 302 of FIG. 3) of engine efficiency versus engine torque. If method 500 judges that the engine is spark limited to lower compression ratio engine efficiency, the answer is yes and method 500 proceeds to 548. Otherwise, the answer is no and method 500 proceeds to 546.

At 546, method 500 switches active cylinders to a higher compression ratio. In some examples where all engine cylinders are variable compression ratio, all engine cylinders may be adjusted to a higher compression ratio. In one example, engine cylinders are adjusted to a higher compression ratio via commanding a variable compression adjusting device to a higher compression mode. Method 500 proceeds to exit after the engine compression ratio is adjusted.

At 548, method 500 switches active cylinders to a lower compression ratio. In some examples where all engine cylinders are variable compression ratio, all engine cylinders may be adjusted to a lower compression ratio. In one example, engine cylinders are adjusted to a lower compression ratio via commanding a variable compression adjusting device to a lower compression mode. Method 500 proceeds to exit after the engine compression ratio is adjusted.

At 550, method 500 judges whether or not a portion of engine cylinders is deactivated. In one example, method 500 judges whether or not a portion of engine cylinders are deactivated based on a position of valve adjusting mechanisms or a value of a variable in controller memory. If method 500 judges that a portion of engine cylinders is deactivated, the answer is yes and method 500 proceeds to 552. Otherwise, the answer is no and method 500 proceeds to 570.

At 552, method 500 judges whether or not the engine is spark is limited to low compression efficiency for torques less than the forth threshold torque (e.g., region D of FIG. 3) and greater than the first threshold torque. In one example, the engine is spark limited to lower compression ratio engine efficiency when spark retard from MBT determined at 520 is greater than a threshold amount of spark retard. Further, the spark retard from MBT spark timing for particular engine operating conditions may be stored in memory and used to adjust a curve (e.g., 302 of FIG. 3) of engine efficiency versus engine torque. If method 500 judges that the engine is spark limited to lower compression ratio engine efficiency, the answer is yes and method 500 proceeds to 554. Otherwise, the answer is no and method 500 proceeds to 560.

At 560, method 500 switches active cylinders to a higher compression ratio. In some examples where all engine cylinders are variable compression ratio, all engine cylinders may be adjusted to a higher compression ratio. In one example, engine cylinders are adjusted to a higher compression ratio via commanding a variable compression adjusting device to a higher compression mode. Method 500 proceeds to 562 after the engine compression ratio is adjusted.

At 562, method 500 judges whether or not engine torque is greater than or equal to a fourth threshold torque (e.g., torque at line 311 of FIG. 3). The fourth threshold torque represents an engine torque for activating deactivated cylinder when the engine is operating with a higher compression ratio. If the engine is operating with a higher compression ratio at 562 the engine is not knock limited at the present engine operating conditions. If method 500 judges that engine torque is greater than or equal to the fourth torque, the answer is yes and method 500 proceeds to 564. Otherwise, the answer is no and method 500 proceeds to exit.

At 564, all engine cylinders are activated. All engine cylinders may be activated by allowing intake and exhaust valves to open and close during a cylinder cycle. Fuel and spark may also be supplied to the engine to reactivate cylinders. Method 500 proceeds to exit after all engine cylinders are activated.

At 554, method 500 method 500 switches active cylinders to a lower compression ratio. In some examples where all engine cylinders are variable compression ratio, all engine cylinders may be adjusted to a lower compression ratio. In one example, engine cylinders are adjusted to a lower compression ratio via commanding a variable compression adjusting device to a lower compression mode. Method 500 proceeds to 556 after the engine compression ratio is adjusted.

At 556, method 500 judges whether or not engine torque is greater than or equal to a third threshold torque (e.g., torque at line 309 of FIG. 3). The third threshold torque represents an engine torque for activating deactivated cylinder when the engine is operating with a lower compression ratio. If method 500 judges that engine torque is greater than or equal to the third torque, the answer is yes and method 500 proceeds to 558. Otherwise, the answer is no and method 500 proceeds to exit.

At 558, all engine cylinders are activated. All engine cylinders may be activated by allowing intake and exhaust valves to open and close during a cylinder cycle. Fuel and spark may also be supplied to the engine to reactivate cylinders. Method 500 proceeds to exit after all engine cylinders are activated.

At 570, method 500 judges whether or not engine torque is less than a second torque threshold (e.g., torque at line 305 of FIG. 3) torque by more than a predetermined amount. The predetermined amount provides hysteresis in the cylinder activation and deactivation torques to reduce undesirable cylinder deactivation. If method 500 judges that engine torque is less than the second threshold torque, the answer is yes and method 500 proceeds to 572. Otherwise, the answer is no and method 500 proceeds to 580.

At 572, method 500 judges whether or not the engine is spark is limited to low compression efficiency for torques less than the second threshold torque (e.g., region B of FIG. 3) and greater than the first threshold torque. In one example, the engine is spark limited to lower compression ratio engine efficiency when spark retard from MBT determined at 520 is greater than a threshold amount of spark retard. Further, the spark retard from MBT spark timing for particular engine operating conditions may be stored in memory and used to adjust a curve (e.g., 302 of FIG. 3) of engine efficiency versus engine torque. If method 500 judges that the engine is spark limited to lower compression ratio engine efficiency, the answer is yes and method 500 proceeds to 574. Otherwise, the answer is no and method 500 proceeds to 578.

At 574, method 500 switches active cylinders to a lower compression ratio. In some examples where all engine cylinders are variable compression ratio, all engine cylinders may be adjusted to a lower compression ratio. In one example, engine cylinders are adjusted to a lower compression ratio via commanding a variable compression adjusting device to a lower compression mode. Method 500 proceeds to 576 after the engine compression ratio is adjusted.

At 578, method 500 switches active cylinders to a higher compression ratio. In some examples where all engine cylinders are variable compression ratio, all engine cylinders may be adjusted to a higher compression ratio. In one example, engine cylinders are adjusted to a higher compression ratio via commanding a variable compression adjusting device to a higher compression mode. Method 500 proceeds to 576 after the engine compression ratio is adjusted.

At 576, method 500 deactivates a portion of engine cylinders. Engine cylinders are deactivated by closing and holding closed cylinder intake and exhaust valves during a cycle of the engine. Additionally, spark and fuel flow to the cylinders is also stopped. Method 500 proceeds to exit after a portion of engine cylinders are deactivated.

At 580, method 500 judges whether or not engine torque is less than a fifth torque threshold (e.g., torque at line 323 of FIG. 3 or region E) torque. If method 500 judges that engine torque is less than the fifth threshold torque, the answer is yes and method 500 proceeds to 582. Otherwise, the answer is no and method 500 proceeds to 588.

At 582, method 500 judges whether or not the engine is spark is limited to low compression efficiency for torques less than the fifth threshold torque (e.g., region E of FIG. 3) and greater than the fourth threshold torque. In one example, the engine is spark limited to lower compression ratio engine efficiency when spark retard from MBT determined at 520 is greater than a threshold amount of spark retard. Further, the spark retard from MBT spark timing for particular engine operating conditions may be stored in memory and used to adjust a curve (e.g., 302 of FIG. 3) of engine efficiency versus engine torque. If method 500 judges that the engine is spark limited to lower compression ratio engine efficiency, the answer is yes and method 500 proceeds to 586. Otherwise, the answer is no and method 500 proceeds to 584.

At 586, method 500 switches active cylinders to a lower compression ratio. In some examples where all engine cylinders are variable compression ratio, all engine cylinders may be adjusted to a lower compression ratio. In one example, engine cylinders are adjusted to a lower compression ratio via commanding a variable compression adjusting device to a lower compression mode. Method 500 proceeds to exit after the engine compression ratio is adjusted.

At 584, method 500 switches active cylinders to a higher compression ratio. In some examples where all engine cylinders are variable compression ratio, all engine cylinders may be adjusted to a higher compression ratio. In one example, engine cylinders are adjusted to a higher compression ratio via commanding a variable compression adjusting device to a higher compression mode. Method 500 proceeds to exit after the engine compression ratio is adjusted.

At 588, method 500 judges whether or not the engine is spark is limited when operated at a higher compression ratios (e.g., in region F of FIG. 3). If method 500 judges that the engine is spark limited at higher compression ratios, the answer is yes and method 500 proceeds to 590. Otherwise, the answer is no and method 500 proceeds to 592.

At 590, method 500 switches active cylinders to a lower compression ratio. In some examples where all engine cylinders are variable compression ratio, all engine cylinders may be adjusted to a lower compression ratio. In one example, engine cylinders are adjusted to a lower compression ratio via commanding a variable compression adjusting device to a lower compression mode. Method 500 proceeds to exit after the engine compression ratio is adjusted.

At 592, method 500 switches active cylinders to a higher compression ratio. In some examples where all engine cylinders are variable compression ratio, all engine cylinders may be adjusted to a higher compression ratio. In one example, engine cylinders are adjusted to a higher compression ratio via commanding a variable compression adjusting device to a higher compression mode. Method 500 proceeds to exit after the engine compression ratio is adjusted.

At 593, method 500 method 500 judges whether or not the rate of engine torque change determined at 522 is greater than a threshold rate. The threshold rate of engine torque change may vary with engine speed, engine temperature, and other operating conditions. Alternatively, method 500 may judge if engine torque is greater than a threshold torque that is requested torque plus a gain factor multiplied by a rate of change of requested engine torque. If method 500 judges that the rate of engine torque change is greater than a threshold rate or if the alternative condition is true, the answer is yes and method 500 proceeds to 594. Otherwise, the answer is no and method 500 proceeds to 540.

At 594, method 500 method judges whether or not all engine cylinders are active. In one example, method 500 judges whether or not all cylinders are active based on engine valve states or a value of a variable stored in controller memory. If method 500 judges that all cylinders are active, the answer is yes and method 500 proceeds to 570. Otherwise, the answer is no and method 500 proceeds to 596.

At 596, method 500 judges whether or not engine spark is limited to less than low compression engine efficiency (e.g., efficiency of the engine when the engine is operated with a low compression ratio) at the present operating conditions. In one example, method 500 compares engine efficiency at the present operating conditions based on if the engine is operated at a high compression ratio and with spark retard from MBT as compared with operating the engine at the same conditions at a lower compression ratio and knock limited spark timing. If method 500 judges that the engine is spark limited to less than low compression ratio engine efficiency, the answer is yes and method 500 proceeds to 598. Otherwise, the answer is no and method 500 proceeds to 599.

At 598, method 500 activates all engine cylinders when engine torque is equal to or greater than a second threshold engine torque (e.g., engine torque at line 305 of FIG. 3) if engine torque is increasing. If engine torque does not reach the thresholds engine torque and engine torque is increasing, method 500 returns to 593 without deactivating a portion or engine cylinders or activating all engine cylinders. On the other hand, if engine torque is decreasing, a portion of engine cylinders are deactivated when engine torque is a predetermined amount of torque less than the second threshold engine torque.

At 599, method 500 activates all engine cylinders when engine torque is equal to or greater than a fourth threshold engine torque (e.g., engine torque at line 311 of FIG. 3). If engine torque does not reach the fourth threshold engine torque, method 500 returns to 593 without activating all engine cylinders. In this way, engine torque at which cylinders are activated may be increased if knock is not detected (e.g., the engine is not spark limited). On the other hand, if engine torque is decreasing, a portion of engine cylinders are deactivated when engine torque is a predetermined amount of torque less than the fourth threshold engine torque.

It should be noted that method 500 may also include hysteresis between torque thresholds to activate and deactivate cylinders so that mode switching busyness may be reduced. For example, an engine torque to deactivate cylinders may be lower than an engine torque to activate cylinders.

Thus, the method of FIGS. 5-8 provides for operating an engine, comprising: varying an engine torque at which engine cylinders are activated in response to a compression ratio of the engine. The method includes where the engine cylinders are activated at a first engine torque when the compression ratio is a first compression ratio, and where the engine cylinders are activated at a second engine torque when the compression ratio is a second compression ratio, the first compression ratio being less than the second compression ratio. The method includes where the first engine torque is greater than the second engine torque.

The method further comprises adjusting the compression ratio of the engine from a higher value to a lower value in response to an indication of engine knock. The method further comprises increasing the engine torque at which engine cylinders are activated in response to an absence of the indication of engine knock when the engine is operating at a second compression ratio, the second compression ratio greater than a first compression ratio. The method includes where engine cylinders are activated via opening and closing intake and exhaust valves during a cycle of the engine where the intake and exhaust valves were not opening. The method further comprises where the compression ratio is varied based on engine efficiency.

In another example, the method includes varying an engine torque at which deactivated cylinders are reactivated in response to a rate of change in engine torque. The method further comprises not varying the engine torque at which deactivated cylinders are reactivated in response to the rate of change in engine torque being less than a threshold rate of change in engine torque. The method includes where the engine torque is a first engine torque when the engine is operating with a lower compression ratio, and where the engine torque is a second engine torque when the engine is operating at a higher compression ratio. The method includes where the first engine torque is greater than the second engine torque.

In another example, the method further comprises adjusting a compression ratio of the engine after deactivated cylinders are reactivated in response to the deactivated cylinders being reactivated. The method further comprises not adjusting a compression ratio of the engine after deactivated cylinders are reactivated in response to the deactivated cylinders being reactivated. The method further comprises varying an engine torque at which active cylinders are deactivated in response to a rate of change in engine torque.

In another example, the method provides for operating an engine, comprising: varying an engine torque at which deactivated cylinders are reactivated in response to a rate of change of engine torque exceeding a threshold and an engine compression ratio immediately before the rate of change of engine torque exceeds the threshold. The method further comprises varying an engine torque at which active cylinders are deactivated in response to a rate of change in engine torque decrease exceeding a threshold and engine compression ratio immediately before the rate of change in engine torque decrease exceeding the threshold. The method includes where the engine torque at which deactivated cylinders are reactivated is lower when the engine compression ratio is a higher compression ratio. The method includes where the engine torque at which deactivated cylinders are reactivated is higher when engine compression ratio is a lower compression ratio. The method further comprises adjusting a compression ratio of the engine in response to reactivating the deactivated cylinders. The method further comprises not varying the engine torque at which deactivated cylinders are reactivated in response to the rate of change in engine torque being less than a threshold rate of change in engine torque.

The method described in FIGS. 5-8 are for an engine which can only deactivate a constant fraction of the cylinders, for example a 6-cylinder engine which can deactivate 3 cylinders. It is well known that other arrangements are possible, for example a 6-cylinder engine which can deactivate either 2 or 3 cylinders at various times. Such engines would have multiple torque regions with various combinations of compression ratio and number of deactivated cylinders, but fundamentally the method would be similar to FIGS. 5-8.

As will be appreciated by one of ordinary skill in the art, method described in FIGS. 5-8 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used. Further, the described actions, operations, methods, and/or functions may graphically represent code to be programmed into non-transitory memory of the computer readable storage medium in the engine control system.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A method for operating an engine, comprising:

during engine operation at a first compression ratio with one or more cylinders deactivated, reactivating the deactivated cylinders when engine torque reaches a first threshold;

during engine operation at a second compression ratio which is greater than the first compression ratio and with one or more cylinders deactivated, reactivating the deactivated cylinders when engine torque reaches a second threshold which is less than the first threshold.

2. The method of claim 1, further comprising varying the first and second thresholds with engine speed, transmission gear, ambient temperature, ambient pressure, and fuel octane.

3. The method of claim 1, further comprising decreasing the compression ratio of the engine in response to an indication of engine knock.

4. The method of claim 3, further comprising:

during engine operation at the second compression ratio with one or more cylinders deactivated, in response to an absence of the indication of engine knock, reactivating the deactivated cylinders when engine torque reaches a third threshold, the third threshold higher than the second threshold.

5. The method of claim 1, where the deactivated engine cylinders are reactivated via opening and closing intake and exhaust valves during a cycle of the engine where the intake and exhaust valves were not opening.

6. The method of claim 1, further comprising where varying the compression ratio of the engine based on engine efficiency.

7. A method for operating an engine, comprising:

during engine operation with one or more cylinders deactivated, while a rate of change in engine torque is less than a rate of change threshold which is equal to a requested engine torque plus a gain factor multiplied by a rate of change of the requested engine torque, not varying an engine torque threshold at which the deactivated cylinders are reactivated;

when the rate of change in engine torque reaches the rate of change threshold, varying the engine torque threshold at which the deactivated cylinders are reactivated; and reactivating the deactivated cylinders when engine torque reaches the engine torque threshold.

8. The method of claim 7, wherein varying the engine torque threshold at which the deactivated cylinders are reactivated when the rate of change in engine torque reaches the rate of change threshold comprises setting the engine torque threshold equal to a first threshold when the engine is operating with a lower compression ratio and setting the engine torque threshold equal to a second threshold which is different from the first threshold when the engine is operating at a higher compression ratio.

9. The method of claim 8, where the first threshold is greater than the second threshold.

10. The method of claim 7, further comprising adjusting a compression ratio of all engine cylinders after the deactivated cylinders are reactivated in response to the deactivated cylinders being reactivated.

11. The method of claim 7, further comprising not adjusting a compression ratio of all engine cylinders after the deactivated cylinders are reactivated in response to the deactivated cylinders being reactivated.

12. A method for operating an engine, comprising:

in response to a rate of change of engine torque exceeding a first threshold, varying an engine torque threshold at which one or more deactivated engine cylinders are reactivated immediately before the rate of change of engine torque exceeds the first threshold, wherein the engine torque threshold is varied to a lower value when a compression ratio of all engine cylinders is higher and to a higher value when the compression ratio of all engine cylinders is lower; and reactivating the deactivated cylinders when engine torque reaches the engine torque threshold.

13. The method for operating an engine of claim 12, further comprising varying an engine torque threshold at which active cylinders are deactivated in response to the rate of change in engine torque decreasing below a second threshold and based on the engine compression ratio of all engine cylinders immediately before the rate of change in engine torque decreases below the second threshold.

14. The method for operating an engine of claim 12, further comprising adjusting the compression ratio of all engine cylinders in response to reactivating the deactivated cylinders.

15. The method for operating an engine of claim 14, further comprising not varying the engine torque threshold at which the deactivated cylinders are reactivated in response to the rate of change in engine torque being less than a third threshold.

16. The method of claim 1, wherein all engine cylinders are operated at the first compression ratio during engine operation at the first compression ratio, and wherein all engine cylinders are operated at the second compression ratio during engine operation at the second compression ratio.

17. The method of claim 1, wherein all engine cylinders are spark-ignited.

18. The method of claim 1, further comprising adjusting the compression ratio of the engine with a variable compression adjusting device.

* * * * *